United States Patent [19]

Coulston et al.

[11] Patent Number: 4,875,627

[45] Date of Patent: Oct. 24, 1989

[54] FREE PASSAGE NOZZLE

[75] Inventors: John W. Coulston, Winfield, Ill.; David C. Huffman, Merrimack, N.H.

[73] Assignee: Lechler, Inc., St. Charles, Ill.

[21] Appl. No.: 216,640

[22] Filed: Jul. 8, 1988

[51] Int. Cl.[4] ..... B05B 1/34; B05B 1/26

[52] U.S. Cl. ..... 239/466; 239/487; 239/501; 239/590.5

[58] Field of Search ..... 239/463, 466, 467, 486–489, 239/491, 493, 494, 496, 497, 500, 501, 590.5

[56] References Cited

U.S. PATENT DOCUMENTS

| | | | |
|---|---|---|---|
| 1,510,174 | 9/1924 | Kelly | 239/466 |
| 3,275,248 | 9/1966 | O'Brien | 239/487 |
| 3,666,183 | 5/1972 | Smith | 239/463 |

FOREIGN PATENT DOCUMENTS

| | | | |
|---|---|---|---|
| 276057 | 9/1913 | Fed. Rep. of Germany | 239/487 |
| 941630 | 1/1949 | France | 239/466 |

*Primary Examiner*—Andres Kashnikow
*Assistant Examiner*—Patrick M. Burkhart
*Attorney, Agent, or Firm*—Fitch, Even, Tabin & Flannery

[57] ABSTRACT

A solid-cone spray nozzle in which the flow-directing vanes are disposed in opposed pairs spaced axially in the nozzle chamber and rotatively displaced a quarter-turn from each other to provide clearance at each vane set, and between them, for the passage of a solid object capable of passing outwardly through the nozzle orifice.

6 Claims, 1 Drawing Sheet

FREE PASSAGE NOZZLE

FREE PASSAGE NOZZLE

This invention relates to spray nozzles and particularly solid-cone spray nozzles for applications in which the liquid being sprayed may entrain solids of sufficient size to clog conventional nozzles intended for similar use.

BACKGROUND OF THE INVENTION

In the scrubbing of flue gas for the removal of its sulfurous content, the gas is passed counterflow to a spray of finely ground limestone in a water slurry from nozzles designed to deliver solid-cone sprays of the slurry downwardly into a reactor vessel through which the hot flue gas from a boiler is passed upwardly. As the sprayed slurry is reclaimed from the bottom of the vessel and recirculated to the nozzles at the top, it is common experience that, in time, the solid materials in the slurry tend to agglomerate and form hard solids of substantial size which can easily clog nozzles of known types for the production of solid-cone sprays.

The problem of nozzle clogging has heretofore been approached in various ways. For example, in the nozzle of U.S. Pat No. 1,510,174, the liquid entering the nozzle body is deflected into a swirling eddy flow by deflector vanes extending radially into the nozzle body from its walls. The problem of clogging is referred to by reference to its solution in that patent, namely, the mounting of the deflector vanes so as to be rotatable about their own axes into axial alignment with the liquid flow to permit the flushing of obstructions and debris collected by the vanes which extend into the nozzle body from its four quadrants.

In addition, the nozzle of U.S. Pat. No. 1,510,174 mounts its flow-directing vanes in a turret within the nozzle body which, while incidentally enabling the nozzle to serve as a stopcock, can also be further rotated to reverse the flow path through the turret to flush the accumulated debris from the flow-directing vanes.

A more recent effort, illustrated by U.S. Pat. No. 4,494,698, addressed specifically to spray nozzles for abrasive slurries, molds the wall-supported flow-directing vanes of flexible polyurethane. This approach seeks to inhibit clogging by permitting deflection of the vanes in order to pass the solid agglomerates inevitably encountered.

While the earlier patent addresses the clogging problem by facilitating maintenance of the nozzle, the later acknowledges the impracticability of shutting down a combustion gas scrubber for nozzle maintenance.

SUMMARY OF THE INVENTION

It is the purpose of the present invention, in contrast, to providing a solid-cone spray nozzle for service of the type described in which the flowdirecting vanes within the nozzle body, which may be rigid, will nevertheless pass any entrained solid mass capable of passing through the nozzle orifice, thereby eliminating to large extent the clogging potential of conventional nozzles for similar service.

In accordance with the invention, the flow directing vanes are arranged in opposed pairs which are spaced in tandem axially of the nozzle body. Each vane covers approximately a quadrant of the cross-section of the nozzle body, leaving an open space in the remaining vacant quadrants of sufficient size to pass any solid capable of exiting the nozzle body through the orifice. An identical pair of vanes spaced axially downstream of the first-mentioned pair, and rotated a quarter-turn about the nozzle axis from the first pair, similarly allows the passage through its vacant quadrants of solids capable of passing through the vacant quadrants of the first set, the two vane pairs being spaced axially sufficiently to pass between them any solid body capable of passing the first vane set.

BRIEF DESCRIPTION OF THE DRAWINGS

The invention is explained in the following specification by reference to the accompanying drawings, in which.

DESCRIPTION OF THE PREFERRED EMBODIMENT

Figure 1:
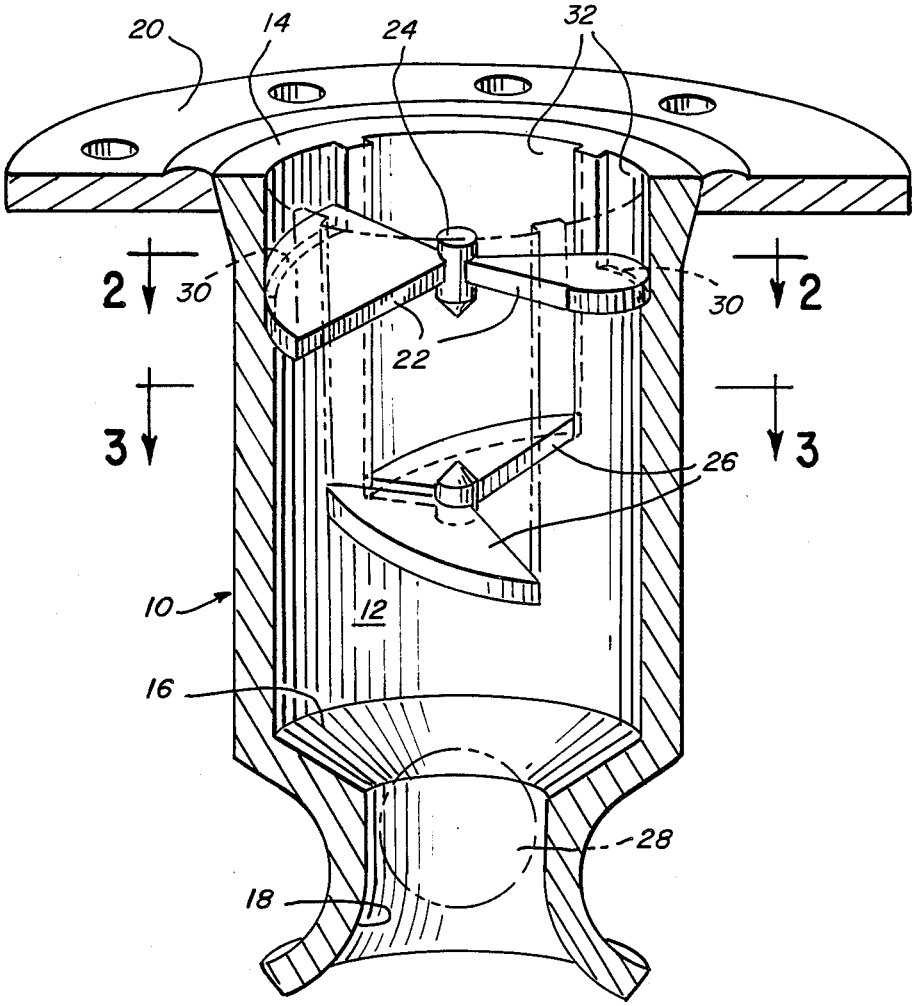
FIG. 1 is an isometric view of the nozzle and its mounting flange sectioned on the central axis to illustrate the interior.

In the embodiment of the invention illustrated, the nozzle body 10, in the form of a cylindrical shell, provides a cylindrical chamber 12 which is fully open at the upper inlet end 14, and merges through a conical wall 16 at its opposite end with an orifice 18 which is outwardly flared or belled to determine the outer limits of the conical discharge from the nozzle. At its upper inlet end, the outer wall of the nozzle body 10 is flared conically for receipt in the mating conical seat of a bolting flange 20 with which the nozzle can be secured, with intervening gasket, to the distribution port of a header or manifold for delivering liquid under pressure to the upper end of the nozzle.

Spaced downwardly from the upper end 14 of the nozzle is an opposed pair of pitched vanes 22 which, for ease of manufacture, are shown as cross-connected by a plug or pin 24 on the central axis of the nozzle body, so as to be handleable as a unit in a form suggesting a propeller, although it will be understood that there is no relative movement between the vanes 22 and the nozzle body 10 in the use of the nozzle.

Figure 2:
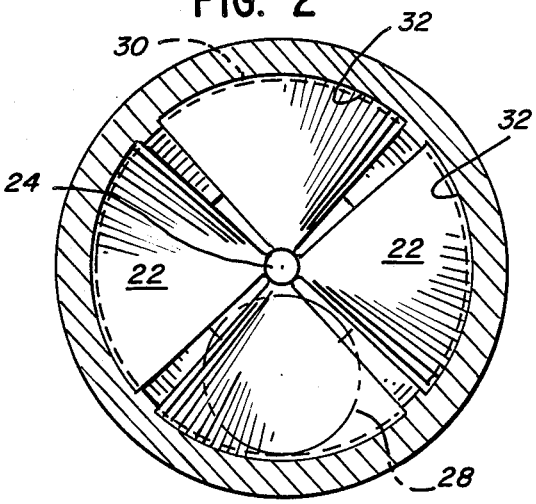
FIG. 2 is a sectional view taken along the line 2—2 of FIG. 1.

Spaced axially downwardly from the first set of vanes 22 is a second set of vanes 26 which may be identical with the first but which is rotatively displaced a quarter-turn from the first-mentioned vane set. The axial projection of each vane of each set occupies somewhat less than one quadrant of the circular cross-section of the valve body, and, as indicated in FIG. 2, the rotative displacement of the vane pairs places each set in line with the opposed quadrants left vacant by the other. The pitch of the vanes is preferably determined by the service, and for the service described may be set at thirty degrees from a transverse plane and, as shown in the drawings, the edge surfaces of each vane are preferably parallel to the axis of the nozzle.

Figure 3:
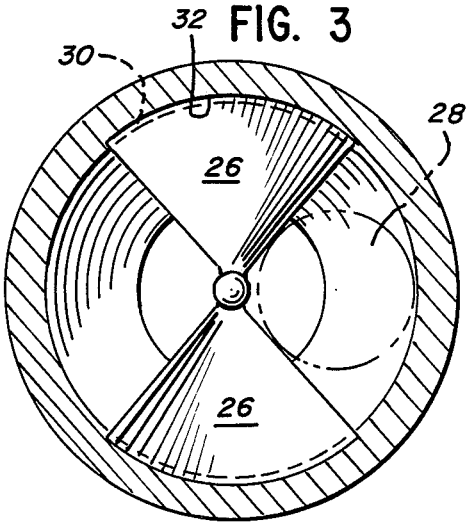
FIG. 3 is a similar sectional view taken on the line 3—3 of FIG. 1.

Further, as shown by the broken-line spheres 28 positioned within the vacant quadrants in the axial projections of FIGS. 2 and 3, and disposed within the nozzle orifice in FIG. 1, any solid mass capable of being discharged through the orifice will also likely pass through the vacant quadrants of each set of flow-directing vanes 22 and 26, each vacant quadrant having a cross-sectional configuration capable of circumscribing a circle of the diameter of the orifice. In addition, the spacing of the two sets of vanes 22 and 26 should be adequate to pass the same sphere freely between the two vane sets, i.e., spaced minimally the diameter of the orifice.

A nozzle of this kind, handling a highly abrasive slurry in the elevated temperature environment of a flue-gas scrubbing reactor, may advantageously be molded of a refractory material such as silicon carbide and sintered into a strong and rigid unitary mass. In such a nozzle, the flow-directing vanes 22 and 26 are preferably also molded of silicon carbide and assembled with the nozzle body while both are in the "green" state. The vanes are anchored in their respective positions in the valve body and preferably filleted with a paste of the same material, which, when fired, secures the vanes in position.

While in one method of ceramic construction, such vanes have been inserted individually into receiving sockets in the inside wall of the nozzle and secured in position with the aforementioned paste, it has been found advantageous for assembly to pre-mold each vane set with the bridging plug 24 between them and to insert each propeller-like vane unit into the nozzle body axially from its upper end 14 with the wide, butt ends of the vanes resting upon ledges 30 at the bottoms of grooves molded 32 in the inner wall of the nozzle body 10 to permit the insertion of the pre-molded vane sets axially into the nozzle. The vane sets are then anchored as were vanes installed individually, i.e., by applying a filleting paste of the ceramic material at the juncture of each vane with the nozzle wall before firing.

The resulting tandem arrangement of flow-directing vanes 22 and 26 produces a solid conical spray pattern equally as satisfactorily as similar nozzles with all flow-directing vanes at the same axial location. It displays little of the clog-proneness of the earlier nozzles, being able by the tandem deflection of the through-flowing liquid to pass and discharge any solid obstruction itself capable of passing through the nozzle orifice.

The features of the invention believed patentable are set forth in the following claims.

What is claimed is:

1. A solid-cone spray nozzle for liquids comprising a shell defining a cylindrical interior space having an ingress opening at one end and a reducing wall at the other end having therein a central orifice, said shell having therein a pair of opposed flow-directing vanes extending from the shell wall into said interior space toward the axis thereof, each said vane being pitched so as to deflect the flow of liquid impinging thereupon into a helical path in the same rotative direction about the axis of said space to induce a vortex in the through-flowing liquid, said cylindrical space having on both sides of said opposed vanes an unobstructed cross-sectional area comprising approximately a quadrant of the cross-section of said cylindrical space, and capable of circumscribing a circle of the diameter of said orifice, and a second pair of opposed flow-direction vanes sized like those of the first-mentioned pair and having the same orientation with respect to each other and to said cylindrical space but being rotatively displaced a quarter-turn from said first-mentioned pair and axially spaced therefrom a minimum distance equal to the diameter of said orifice.

2. The nozzle of claim 1 wherein each said vane projects axially of the nozzle as somewhat less than a quadrant of the cross-section of said cylindrical space and is supported by the shell wall.

3. The nozzle of claim 1 or 2 wherein each of the vanes is joined to its associated opposed vane at the axis of said cylindrical space.

4. The nozzle of claim 1 wherein the interior surface of said reducing wall is conical.

5. The nozzle of claim 4 wherein the orifice extends axially outwardly from said reducing end wall as an outwardly flaring channel.

6. A solid-cone spray nozzle for liquids comprising a shell defining a cylindrical interior space having an ingress opening at one end and a reducing wall at the other end having therein a central orifice, said shell having therein a pair of opposed flow-directing vanes extending from the shell wall into said interior space toward the axis thereof, each said vane being pitched so as to deflect the flow of liquid impinging thereupon into a helical path in the same rotative direction about the axis of said space to induce a vortex in the through-flowing liquid, said cylindrical space on each side of said opposed vanes comprising approximately a quadrant of the cross-section of said cylindrical space, and being able to pass a sphere capable of passing through said orifice, and a second pair of opposed flow-directing vanes sized like those of the first-mentioned pair and having the same orientation with respect to each other and to said cylindrical space but being rotatively displaced a quarter-turn from said first-mentioned pair and axially spaced therefrom sufficiently to pass said sphere between them.

* * * * *